US005088197A

United States Patent [19]

Anderson

[11] Patent Number: 5,088,197

[45] Date of Patent: Feb. 18, 1992

[54] POWER-DRIVEN CHAIN SAW

[75] Inventor: Harvey G. Anderson, Muskegon, Mich.

[73] Assignee: Pro Power Corporation, Kalamazoo, Mich.

[21] Appl. No.: 521,582

[22] Filed: May 10, 1990

Related U.S. Application Data

[63] Continuation of Ser. No. 294,765, Jan. 6, 1989, Pat. No. 4,945,637.

[51] Int. Cl.[5] ..... B27B 17/08; B27B 17/12

[52] U.S. Cl. ..... 30/122; 30/123.4; 30/124; 30/381

[58] Field of Search ..... 30/122, 123.4, 124, 30/381, 500

[56] References Cited

U.S. PATENT DOCUMENTS

| | | | |
|---|---|---|---|
| 2,839,097 | 6/1958 | Siria | 30/122 |
| 2,879,814 | 3/1959 | Scott | 30/122 |
| 4,033,035 | 7/1977 | Trimmer | 30/122 |
| 4,223,438 | 9/1980 | Kerrison | 30/123.4 |
| 4,270,270 | 6/1981 | Loyd | 30/122 |
| 4,272,889 | 6/1981 | Scott et al. | 30/122 X |
| 4,414,743 | 11/1983 | Pioch et al. | 30/124 |
| 4,649,644 | 3/1987 | Huddleston | 30/122 |
| 4,819,332 | 4/1989 | Sugihara et al. | 30/123.4 |
| 4,819,335 | 4/1989 | Alexander | 30/122 X |
| 4,858,318 | 8/1989 | Anderson | 30/122 |

*Primary Examiner*—Frank T. Yost
*Assistant Examiner*—Rinaldi Rada
*Attorney, Agent, or Firm*—Gordon W. Hueschen

[57] ABSTRACT

There is disclosed a power-driven chain saw converted from a stripped-down power-driven circular power hand saw which has a unitary housing adapted to be mounted on the power unit of the stripped-down power-driven hand saw. The housing has bosses or raised portions which separate the housing into three vertical channels the sides of which are intact down to the open bottom ends thereof. The bosses are for mounting a chain support bar and a guard member and the channels are first, for the ascending chain, the second is for the descending chain, and the third, for venting sawdust. A deflector deflects sawdust into the vent channel. A sprocket floats on a splined shaft to accommodate different support bars, and special oiling ducts and special support bar adjustments are disclosed.

13 Claims, 4 Drawing Sheets

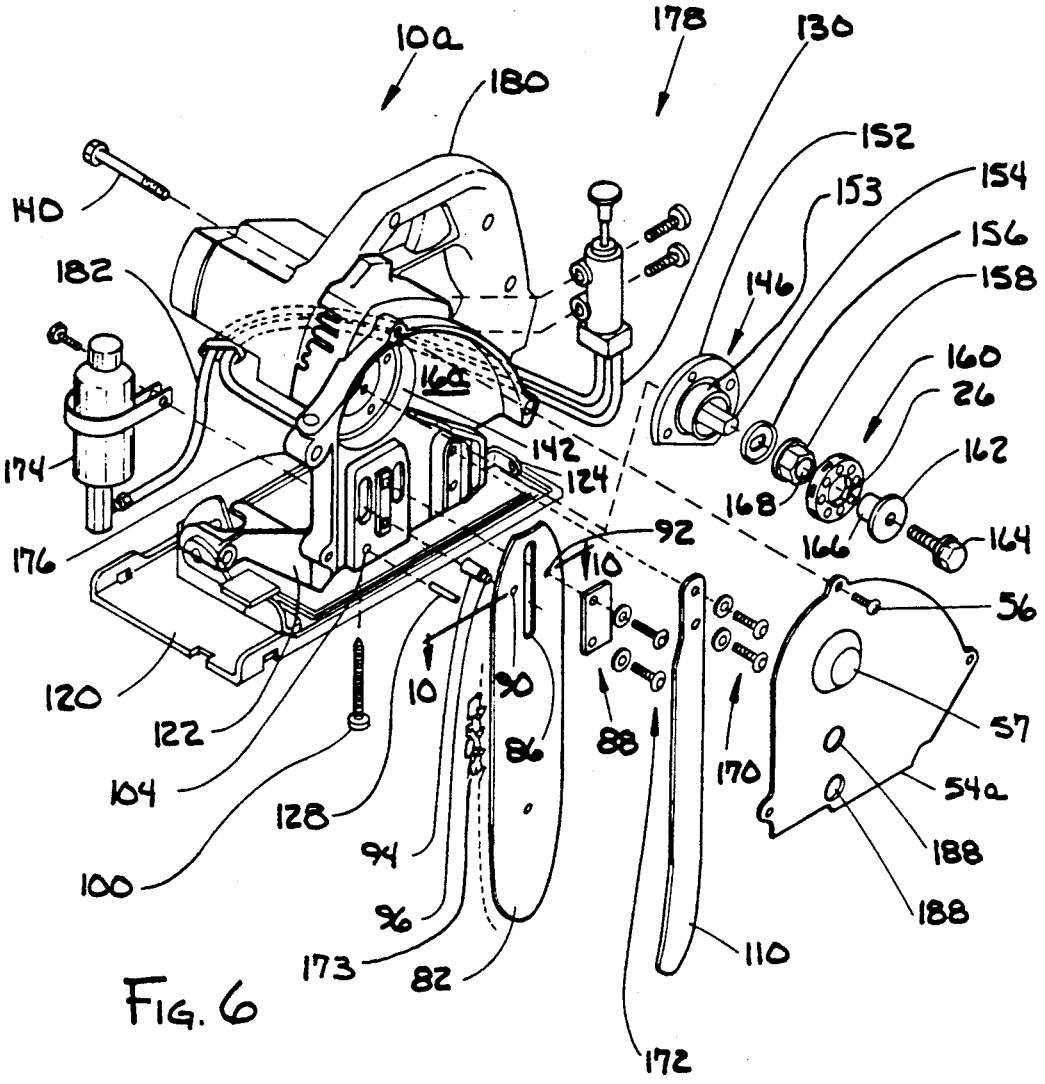
FIG. 6
FIG. 10
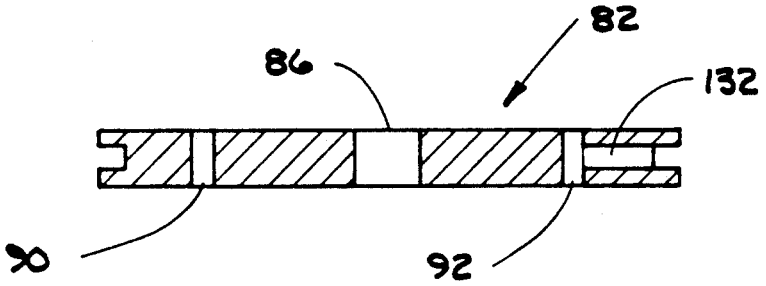

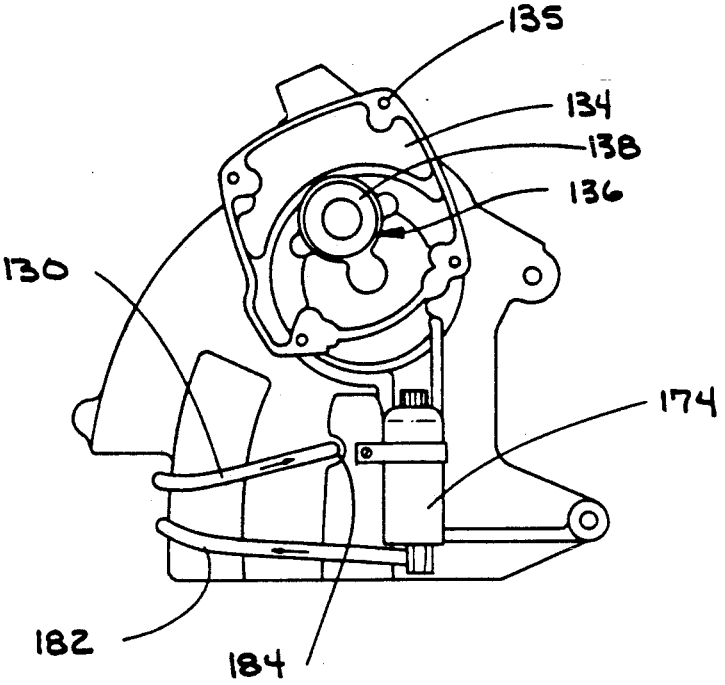
Fig. 7
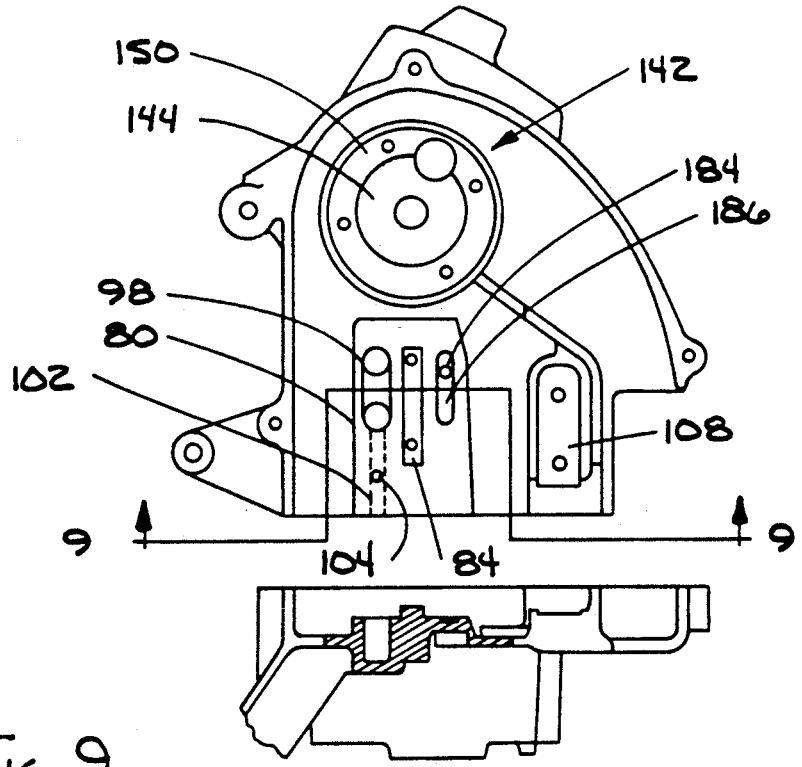
Fig. 8
Fig. 9

POWER-DRIVEN CHAIN SAW

FIELD OF THE INVENTION AND THE PRIOR ART

This application is in part a continuation of my copending application Ser. No. 294,765 filed Jan. 6, 1989, now U.S. Pat. No. 4,945,637.

This invention relates to a power-driven chain saw converted from a power-driven circular hand saw and to a housing therefor.

Various conversion chain saws obtained by converting a circular power hand saw are known in the art. For example, in U.S. Pat. No. 2,839,097, a chain saw support-bar mounting block is affixed to the power unit of a circular power hand saw and a chain saw drive sprocket is mounted on the power drive shaft instead of the circular saw to drive a chain saw chain around the support bar. The support bar is clamped onto the mounting block by a tension-adjusting clamp block. The chain saw attachment of this patent is to that kind of chain saw, which will be referred to as a pin-and-groove type because the chain is guided around the support bar by a pin or tongue riding in a peripheral groove in the support bar.

Similar conversion chain saws are disclosed in U.S. Pat. Nos. 4,270,270, 4,272,889, and 4,033,035.

Another type, to be referred to herein as a saddle-type chain saw, is disclosed in U.S. Pat. No. 4,309,931. In this type, the chain links have bearing faces which ride on the peripheral edge of the support bar and side members or flanges which center the chain on the support bar. A special sprocket, referred to herein as a saddle-type chain sprocket, is used. This kind of sprocket and a saddle-type chain conceivably can be substituted in U.S. Pat. No. 2,839,097, but efforts to make such substitutions have not been satisfactory heretofore.

Other prior art that may be of interest will be found cited in my parent application.

OBJECTS OF THE INVENTION

It is an object of the invention to overcome the disadvantages of the prior art. Another object is to provide new and effective chain saws converted from a power-driven circular hand saw. It is a further object to provide a unitary replacement housing for converting a power-driven circular hand saw to a power-driven chain saw. Another object is to provide a chain saw housing having means for venting the sawdust, especially for venting it down in the direction taken by the return traverse of the chain. It is yet a further object to provide a new, useful, and unobvious chain saw. These and further objects will be come apparent as the description proceeds.

SUMMARY OF THE INVENTION

This invention relates to a power-driven chain saw comprising a housing member for enclosing a chain-saw sprocket for driving a chain-saw chain and a portion of the driven chain;

said housing member having essentially parallel channels with intact walls extending to open bottom ends, one of which is a first channel through which said chain travels on its way to said sprocket, another of which is a second channel through which said chain travels after it leaves said sprocket, and the third of which is a vent channel through which sawdust is vented through its open bottom end, and deflecting means for deflecting sawdust into said vent channel.

The invention is also directed to one or more modifications in which said deflecting means comprises a deflecting wall angling up from said vent channel toward said sprocket up to and adjacent the traverse of said chain as it enters said second channel;

in which said deflecting wall has a portion extending across said second channel beneath the traverse of said chain;

in which said first and second channels are separated by a chain support-boss for mounting a chain support-bar and said second channel is separated from said vent channel by a guard support-boss;

further comprises a shoe adapted to rest on a workpiece when the saw is being used and in which said first and second channels extend essentially to said shoe but the vent channel does not and vents saw dust into ambient air above said shoe and away from said second channel; or in which said first and second channels are separated by a chain support-boss for mounting a chain support-bar and said second channel is separated from said vent channel by a guard support-boss and in which said bosses extend to a position closely adjacent said shoe.

The invention is also directed to a housing member for a chain saw comprising essentially parallel channels with intact walls extending to open bottom ends one of which is a first channel through which the chain of said chain saw travels on it way to a drive sprocket, another of which is a second channel through which said chain travels after leaving said sprocket, and the third of which is a vent channel through which sawdust is vented through its open bottom end, and deflecting means for deflecting sawdust into said vent channel and to one or more modifications as described above.

The invention furthermore is directed to a chain saw comprising a housing member having a raised support which is adapted to have a chain-saw chain support-bar mounted thereon;

guide means to keep a chain-saw on said support bar;

a driven sprocket mounted in alignment with said support bar adapted to drive said chain around said support bar;

said support bar being fastened on said raised support with a relatively long slot in said support bar engaging a complementary raised tongue on said raised support;

said slot being longer than said tongue so that said support bar can be adjusted longitudinally on said raised support to adjust tension on said chain;

said support bar having a through-hole on each side of said slot;

an elongated groove in said support bar parallel to said raised tongue adapted to register with one of said through-holes;

a transverse bore leading from said one through-hole to said guide means;

oil supply means communicating with said elongated groove;

cover means for covering said one through-hole, whereby oil pumped into said elongated groove is forced through said transverse bore to the periphery of said support bar to provide lubrication for a chain mounted thereon; including one or more modifications in which said cover means is comprised within the means for fastening said support bar onto said raised support; or which comprises:

an elongated depression along the side of said tongue in registry with the second said through-hole;

a threaded screw disposed lengthwise in said depression and keyed to rotate in place therein; and a follower threaded on said screw and adapted to be moved back and forth in said depression on rotation of said screw and having a protuberance on the end thereof adapted to fit in said second through-hole, whereby when said screw is turned, the movement imparted to said follower is also imparted to said support bar.

The invention also is directed to a chain saw comprising a housing member having a raised support which is adapted to have a chain-saw chain support-bar mounted thereon;

guide means to keep a chain-saw chain on said support bar;

a driven sprocket mounted in alinement with said support bar adapted to drive said chain around said support bar;

said support bar being fastened on said raised support with a relatively long slot in said support bar engaging a complementary raised tongue on said raised support;

said slot being longer than said tongue so that said support bar can be adjusted longitudinally on said raised support to adjust tension on said chain and having a through a hole on each side of said slot;

an elongated depression along the side of said tongue in registry with the second said through-hole;

a threaded screw disposed lengthwise in said depression and keyed to rotate in place therein; and a follower threaded on said screw and adapted to be moved back and forth in said depression on rotation of said screw and having a protuberance on the end thereof adapted to fit in said second through-hole, whereby when said screw is turned, the movement imparted to said follower is also imparted to said support bar.

Additionly, the invention is directed to improvements in a power-driven chain saw which comprises:

a power unit having a mounting face and a drive shaft projeting normally therefrom;

a housing member having a base portion, the reverse face of which is adapted to be affixed to said mounting face;

side members which project from all of the periphery of said base portion except the bottom edge thereof;

a cover member adapted to be affixed to said side members;

a driven shaft projecting from said base portion axially into said housing member parallel to said side members and adapted to be driven by said drive shaft when said housing member is mounted on said mounting face;

a chain-saw sprocket mounted on said driven shaft within the confines of said housing member;

a chain-saw chain support bar affixed to said housing member on a raised support-bar boss on the obverse face of said base member in functional alinement with said sprocket;

a raised chain-saw chain guard support-boss on the obverse face of said base member;

said support-bar boss having parallel side faces, one of which is parallel to a side member and forms therewith a first chain-saw chain channel for the portion of the chain traveling to the sprocket and the other of which is parallel to a face of said guard-support and forms therewith a second chain-saw chain channel for the portion of the chain traveling from the sprocket;

in which improvement in said housing member:

the sides of said housing member comprise an arcuate portion spanning said first and second channels and flaring out and down beyond said guard support-boss thereby forming a vent channel for venting sawdust; and deflecting means for deflecting sawdust into said vent channel; and to one or more modifications thereof in which said deflecting means comprises a deflecting wall angling up from said vent channel toward said sprocket up to and adjacent the path of said chain as it enters said second channel; and in which said deflecting wall has a portion extending across said second channel beneath the path of said chain.

The invention also relates to a power-driven chain saw comprising a driven shaft, a sprocket, and a chain support bar, said sprocket being splined onto to said driven shaft loosely enough to permit movement back and forth on said driven shaft, whereby said sprocket automatically adjusts to accommodate support bars of different thicknesses.

BRIEF DESCRIPTION OF THE DRAWINGS

FIG. 6 is an exploded view of another modification;

FIG. 7 is a plan view of the reverse side of the housing base member;

FIG. 8 is a plan view of the obverse face of the housing base member;

FIG. 9 is a cross section taken on line 9—9 of FIG. 8; and

FIG. 10 is an enlarged section taken on line 10—10 of FIG. 6.

DESCRIPTION OF PREFERRED EMBODIMENTS

Figures 1, 1A:
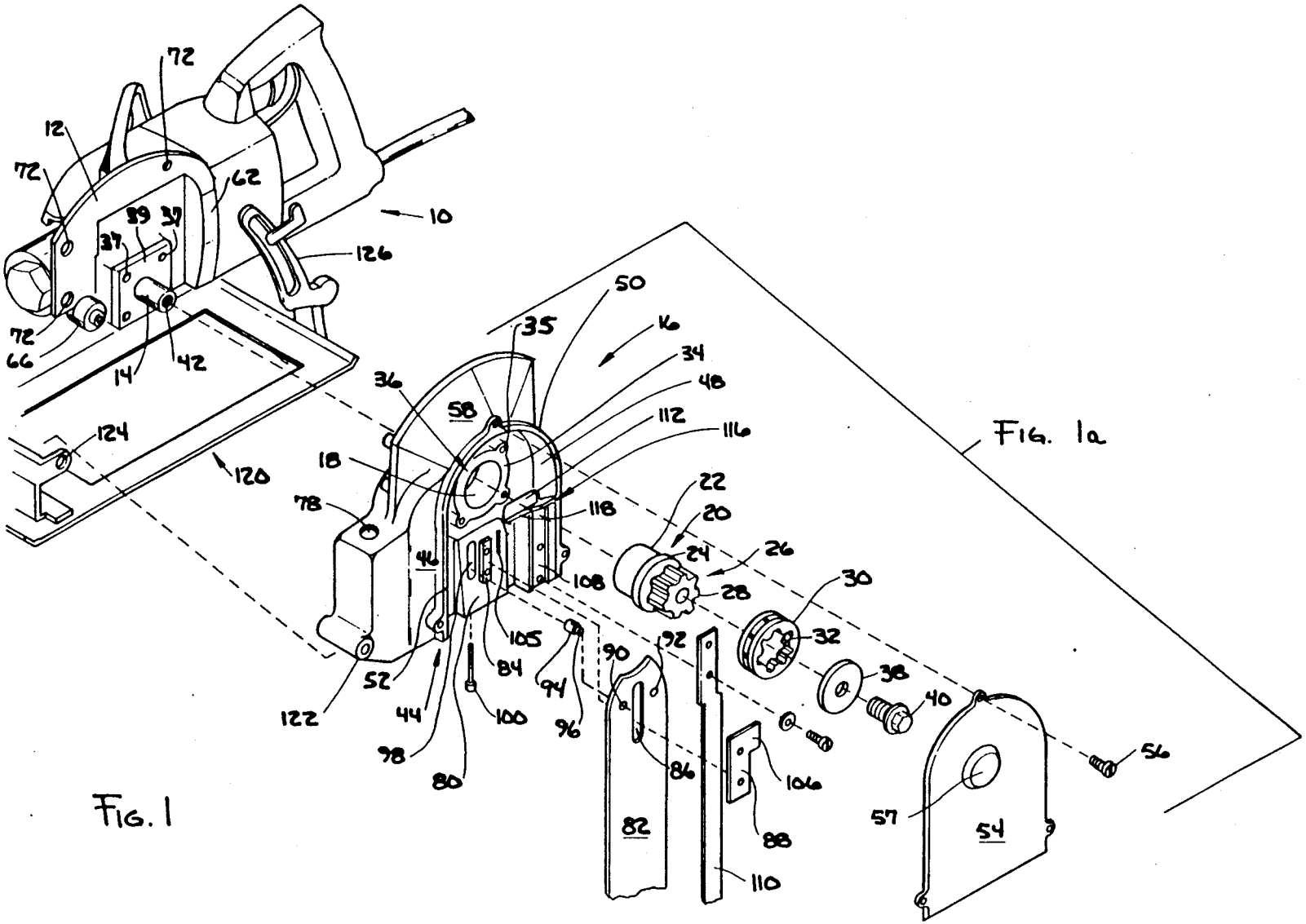
FIG. 1 is an exploded view of a chain saw of the invention.
FIG. 1*a* indicates the entire second housing assembly.
Figure 4:
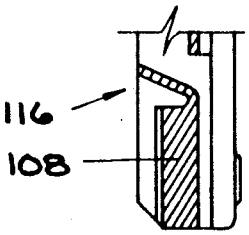
FIG. 4 is a section on line 4—4 of FIG. 2.
Figure 3:
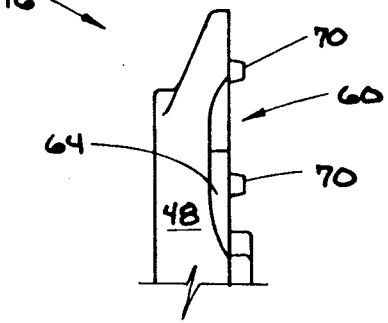
FIG. 3 is a side view of FIG. 2 looking in the direction of the arrow.
Figure 2:
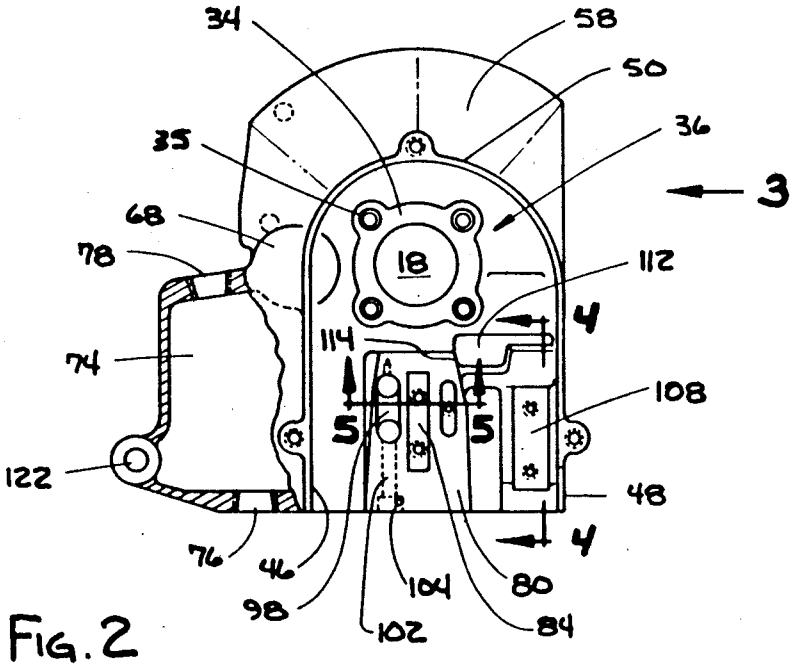
FIG. 2 is a face view of the replacement housing as shown in FIG. 1.
Figure 5:
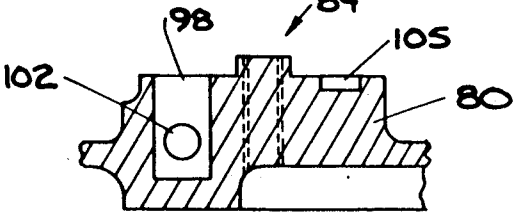
FIG. 5 is a section on line 5—5 of FIG. 2.

Referring now to the drawings, FIGS. 1–5 illustrate one embodiment and FIGS. 6–10 another. Like parts will each be referred to by the same number and some parts will be described in detail with respect to only one modification.

In FIG. 1, 10 is a stripped-down power unit of a circular power hand saw which has been stripped of its circular blade and the protective housing thereof leaving a housing mounting face 12 and a driven shaft 14 projecting normally therefrom. A replacement housing 16 having a bore 18 in axial alinement with driven shaft 14 is mounted on the housing mounting face 12 with the driven shaft 14 projecting axially into bore 18 but not through it.

In alinement with the driven shaft 14 is a connecting shaft 20 having a cylindrical drum-like portion 22, a flange portion 24, and a rough-splined portion 26 having teeth 28 like a pinion gear. A chain-saw sprocket 30 is provided with internal splines or teeth 32 complementary with the splines or teeth 28 of the rough-splined portion so that the sprocket 30 can be slipped on and off of the rough-splined portion 26 as desired. The connecting shaft 20 is adapted to be slipped into the bore 18 and secured to the driven shaft 14 by splining, keying, bolting, or other means. The dimensions are such that the drum-like portion 22 fits snugly in the bore 18 and forms therewith a bearing. The flange portion 24 fits snugly against the front face 34 which forms the outer annular portion 36 of the bearing which has complementary bores 35 and 37 for bolting the annular portion 36 to the anchor plate 39.

All the portions of the replacement housing 16, unless otherwise specified, are cast or otherwise formed as a unitary integral structure. If desired, however, frictionless bearing surfaces (not shown) can be interposed between the bore 18 and the drum-like portion 22, for example, roller bearing races, oilless bronze sleeves, or the like, or that portion of the replacement housing can be substituted by a separate standard machine bearing.

In the embodiment of FIG. 1, the connecting shaft 20 and the sprocket 30 are secured together to rotate as a unit with the driven shaft 14 by means of washer 38 and bolt 40 adapted to be threaded into an internally threaded axial bore 42 in the end of driven shaft 14. Alternatively, the shaft 14 can be splined or keyed into an axial bore in the drum-like portion 22.

The replacement housing 16 has an upstanding flange 44, parallel sides 46 and 48, a convex semicircular top 50 and an open bottom. It is to be understood that top, bottom and like terms of orientation apply to the drawings because the device itself, being portable, can be positioned in an infinite number of different orientations. The front faces 52 of the sides and top of the flange 44 all lie in a common plane which is normal to the axis of the drive shaft 14. A complementary cover plate 54 is adapted to be bolted to, or otherwise fastened to, flange 44 by a number of bolts, or the like, one of which is illustrated at 56. This cover plate has on its inner face an axially-disposed impression or indentation 57 conforming with the end of the sprocket assembly which allows the major portion of the cover to be closely opposed to the circulating chain.

The upper portion of the replacement housing 16 comprises an upstanding plate 58 conforming to the upper portion of the housing mounting face 12 and the rear face 60 is shaped to conform to the shape of the stripped down power unit 10. Thus, where the power unit bulges out as shown at 62, there is provided a complementary depression 64 in the replacement housing 16 and, where a cylindrical artifact 66 projects from the power unit 10, it fits snugly in a complementary cylindrical depression, as shown at 68. The rear face 60 has protuberances 70 which are shaped to fit the bolt holes 72 in the housing mounting face 12 and which are internally threaded (not shown) so that the replacement housing 16 can be firmly and rigidly affixed to the stripped-down power unit 10.

The replacement housing 16 has an integrally-formed oil reservoir 74 which has upper and lower openings 76–78 which are artifacts of the casting process. One, usually the bottom one 76, is plugged and the other is threaded to receive an oil filler fitting (not shown).

The inner or obverse face of the replacement housing 16, in both modifications, is provided with a mounting boss or raised platform 80, as shown in FIGS. 1, 2, 5, 6, and 8, which is adapted for mounting thereon a chain-saw support bar 82. The boss 80 has a elongate, vertical boss or tongue 84 complementary to the mounting slot 86 in the support bar 82 and has a height essentially equal to, advantageously a little less than, the thickness of the support bar 82 so that, when the support bar 82 is affixed on the mounting boss 80 with the elongate boss or tongue 84 seated in the mounting slot 86, a clamping plate 88 can be bolted thereon to hold the support bar 82 firmly and rigidly on the mounting boss 80. The height of the mounting boss 80 is such that the support bar 82 is in alinement with the sprocket 26 so that a chain saw chain can be mounted thereon and driven by the sprocket 26. The support bar 82 can be provided with a peripheral groove (shown in FIG. 10) to guide the chain saw blade and keep it on the support bar 82, but other means for accomplishing these ends can be used. The length of the slot 86 is such that the position of the support bar 82 on the mounting boss 80 can be vertically moved up or down as needed to adjust the tension on the chain saw chain.

The support bar 82 has two through-holes therethrough, one on each side of the elongate slot 86. These holes and slot can be artifacts in the manufacture of the support bar. The slot 93 can be used to effect further bolting-down of the support bar 82, if desired, and the apertures 90 and 92 can be utilized as described below.

In order to effect adjustment of the tension on the chain when it is on the support bar 82, a traveler 94 having a protuberance 96 adapted to fit into apertures 90 is mounted in an elongate channel 98 on an elongate screw 100 which, in turn, is mounted in a vertical bore 102 extending from the bottom of the mounting boss 80 up through the channel 98. The screw 100 is held against vertical movement by a pin (shown at 128 in FIG. 6) driven in a bore 104 provided therefor. A like pin and bore (not shown) may also be provided in the modification of FIG. 1. Thus, when the screw is turned one way the traveler 94 is moved up and, when it is turned in the opposite direction, the traveler 94 is moved down and the corresponding movement is imparted to the support bar 82 by the protuberance 96.

The mounting boss 80 has an elongate, vertical oil groove or depression 105 into which oil is adapted to be pumped through a suitable conduit (shown at 130 FIG. 6) and the support bar 82 has a transverse bore (shown at 132 FIG. 10) which extends from the right periphery of the support bar 82 to the aperture 92 which is alined with oil groove 105 so that oil can be conducted to a chain riding on the support bar 82. The aperture 92 need not go all the way through the support bar 82, only up to communication with the transverse bore but, if it does, the clamping plate 88 can be provided with an extension 106 which covers aperture 92.

At or adjacent the inside of the flange 48, there is provided a guard mounting boss 108 on which can be mounted chain guard 110. This guard mounting boss is positioned to hold the guard 110 along and adjacent the non-cutting edge of the chain. It is to be noted that the space between the flange 46 and the mounting boss 80 is only as wide as needed for the chain to circulate around the support bar 82, whereas the space between the flange 48 and the mounting boss 80 is considerably wider. This provides ample room for the guard mounting block 108 and for means for keeping the sawdust from being circulated into and accumulating in the housing 16. For this purpose there is provided a transverse window 112 extending from side 48 to adjacent the mounting boss 80. If desired the upper corner of the mounting boss can be cut back as shown at 114 in order to make the window 112 longer. At the bottom edge of window 112 there is provided a deflecting flange 116 which extends upwardly and outwardly to a position adjacent the cover 54 except for the portion 118 which is in the path of the circulating chain.

If desired, foot plate or shoe 120 can be mounted on the bottom of the replacement housing similar to or identical with the foot plate of the original circular power saw. It can be hinged to the replacement housing 16 by hinge elements 122 and 124 and can have an angle adjustment 126 at the opposite end.

In the modification of FIGS. 6-10 the axis of the motor of power unit 10*a* is normal to the plane of support bar 82 whereas the axis of the motor of power unit 10 in FIG. 1 is parallel to the plane of support bar 82. On this account the reverse face of the housing 16*a* has a mounting face 134 shaped for mounting on the power unit. The mounting face 134 has an axial bore 136 lined with a bearing 138 through which the driveshaft (not shown) of the power unit projects into the housing 16*a* offset from the axis of the housing 16*a* but in line with the axis of the power unit 10*a*. The mounting face 134 has four boltreceptor, threaded holes 135 whereby the housing 16*a* can be bolted to the power unit 10*a*, one such bolt being shown at 140.

The obverse face of the housing 16*a* has a tiered cylindrical depression 142, the lower tier 144 of which houses a reducing gear (not shown) which is adapted to mesh with a spur gear (not shown) on the drive shaft (not shown) of the power unit 10*a*. These gears are not illustrated as such reduction gearing is well knownin the art. A reduction unit 146 is adapted to fit into the tiered depression 144 and to be bolted to the tier annulus 150 into the holes shown in the tier annulus and through the complementary holes in flange 152. The flange 152 has a bearing 153 in which the driven shaft 154 is journaled. A washer 156 fits over the shaft 154 as does a splined head 158 which is internally splined to rotate with the shaft 154 and externally splined to receive a chain-saw sprocket 160. The sprocket 160 is fastened onto the shaft 154 by means of the washer 162 and bolt 164 which is threaded into the end of the shaft 154 in an internally threaded axial bore (not shown) therein. The washer 162 has a cylindrical portion 166 adapted to fit into a bore 168 in the splined head 158 and the latter has an axial length somewhat greater than the thickness of the sprocket 160 so that the latter can shift back and forth on the splined head 158 to make the sprocket self-alining with the support bar 82. Thus support bars of different thickness can be mounted without the necessity of changing sprockets.

Bolts 170 are provided to bolt the chain guard 110 on the chain guard-support 108 and bolts 172 are provided to bolt the support bar 82 onto the mounting boss 80. A cover plate 54*a* is bolted by bolts 56 to the sides of the housing to provide a completely closed housing save for the bottom thereof.

The shoe 120 is a standard part of the circular saw and the housing is positioned thereon so that the chain support bar 82 with the chain 173 thereon projects through the hole through which the circular blade had projected. An imperforate end of the shoe 120 extends beneath the bottom opening of the vent channel and functions to deflect sawdust away from the second channel.

An oil reservoir 174 is bolted to the housing ear 176 and hand pump 178 which is mounted adjacent the handle 180 of the power unit 10*a* receives oil through line 182 and delivers oil through hole 184 into elongated groove 186 through line 130 whence it passes into the through hole 92 and transverse bore 132 to the edge of the support bar 82 where it oils the chain.

The cover plate 54*a* is provided with holes 188 in registry with the bolts 172 so that the support bar 82 can be adjusted without having to remove the cover plate 54*a*.

There is thus provided a chain saw which has been converted from a circular power saw which can be readily mounted or taken down and which provides for safe and effective operation. There is provided such a saw in which the sprocket and the upper portions of the chain are completely enclosed in a replacement housing and in which means is provided for minimizing the tendency for sawdust to accumulate in an enclosed housing and to keep it from following the chain down as it exits the second channel.

While the invention has been described with reference to particular embodiments thereof, it is to be understood that it is not to be limited in the details of these embodiments as variations will readily be apparent to those skilled in the art once they have been apprised of the invention and that the invention, accordingly, is not to be limited except by the scope of the appended claims.

I claim:

1. In a power-driven chain saw which comprises:

a power unit having a mounting face and a drive shaft projecting normally therefrom;

a housing member having a base portion, having a bottom edge and an obverse face, the reverse face of which is adapted to be affixed to said mounting face;

side members which project from all of the periphery of said base portion except at the bottom edge thereof;

a cover member adapted to be affixed to said side members;

a driven shaft projecting from said base portion axially into said housing member parallel to said side members and adapted to be driven by said drive shaft when said housing member is mounted on said mounting face;

a chain-saw sprocket mounted on said driven shaft within said housing member;

a chain-saw chain support bar affixed to said housing member on a raised support-bar boss on the obverse face of said base member in functional alinement with said sprocket;

a raised chain-saw chain guard support-boss on the obverse face of said base portion;

said support-bar boss having parallel side faces, one of which is parallel to a side member and forms therewith a first chain-saw chain channel for the portion of the chain traveling to the sprocket and the other of which is parallel to a face of said guard-support and forms therewith a second chain-saw chain channel for the portion of the chain traveling from the sprocket;

the improvement in said housing member in which:

the sides of said housing member comprise an arcuate portion spanning said first and second channels and flaring out and down beyond said guard support-boss thereby forming a vent channel for venting sawdust; and deflecting means for deflecting sawdust into said vent channel.

2. An improvement in a power-driven chain saw according to claim 1 in which said deflecting means comprises a deflecting wall angling up from said vent channel toward said sprocket up to and adjacent the path of said chain as it enters said second channel.

3. An improvement in a power-driven chain saw according to claim 2 in which said deflecting wall has a portion extending across said second channel beneath the path of said chain.

4. A power-driven chain saw comprising:

a driven chain saw chain;

a housing member for enclosing a chain saw sprocket for driving said chain saw chain and a portion of said chain;

said housing member having essentially parallel channels, one of which is a first channel through which said chain travels on its way to said sprocket and another of which is a second channel through which said chain travels after it leaves said sprocket; and a third channel which is a vent channel and has an open bottom end through which sawdust is vented; and deflecting means for deflecting sawdust away from said second channel into said vent channel;

said deflecting means separating said second channel from said vent channel.

5. A power-driven chain saw according to claim 4 in which said deflecting means comprises a deflecting wall angling up from said vent channel toward said sprocket up to and adjacent said chain as it enters said second channel.

6. A power-driven chain saw according to claim 5 in which said deflecting wall has a portion extending across said second channel beneath the path of said chain.

7. A power-driven chain saw according to claim 4 in which said first and second channels are separated by a chain support-boss for mounting a chain support-bar and said second channel is separated from said vent channel by a guard support-boss.

8. A power-driven chain saw according to claim 4 which further comprises a shoe adapted to rest on a workpiece when the saw is being used and in which said first and second channels extend essentially to said shoe but the vent channel does not and vents saw dust into ambient air above said shoe and away from said second channel.

9. A power-driven chain saw according to claim 8 in which said first and second channels are separated by a chain support-boss for mounting a chain support-bar and said second channel is separated from said vent channel by a guard support-boss and in which said bosses extend to a position closely adjacent said shoe.

10. A housing member for a chain saw having a chain saw chain comprising essentially parallel channels, one of which is a first channel through which said chain travels on its way to a drive sprocket and another of which is a second channel through which said chain travels after leaving said sprocket; and a third channel which is a vent channel and has an open bottom end through which sawdust is vented; and deflecting means for deflecting sawdust away from said second channel into said vent channel;

said deflecting means separating said second channel from said vent channel.

11. A housing member according to claim 10 in which said deflecting means comprises a deflecting wall angling up from said vent channel toward said sprocket up to and adjacent said chain as said chain enters said second channel.

12. A housing member according to claim 11 in which said deflecting wall has a portion extending across said second channel beneath the path of said chain.

13. A housing member according to claim 10 in which said first and second channels are separated by a chain support-boss for mounting a chain support-bar and said second channel is separated from said vent channel by a guard support-boss.

* * * * *